US006198243B1

(12) United States Patent
Ritmanich et al.

(10) Patent No.: US 6,198,243 B1
(45) Date of Patent: Mar. 6, 2001

(54) METHOD FOR AUTOMATICALLY DETERMINING RANGE OF MOVEMENT OF AN ELECTROMECHANICAL ACTUATOR

(75) Inventors: David C. Ritmanich, Brookfield; Douglas G. Knutzen, Fon du Lac; William R. Kuckuk, Hubertus, all of WI (US)

(73) Assignee: Johnson Controls Technology Co., Plymouth, MI (US)

( * ) Notice: Subject to any disclaimer, the term of this patent is extended or adjusted under 35 U.S.C. 154(b) by 0 days.

(21) Appl. No.: 09/256,594

(22) Filed: Feb. 23, 1999

(51) Int. Cl.[7] ..... H02H 7/08

(52) U.S. Cl. ..... 318/466; 318/266; 318/467; 318/468

(58) Field of Search ..... 318/466, 467, 318/468, 696, 286, 266, 695, 685

(56) References Cited

U.S. PATENT DOCUMENTS 4,401,930 * 8/1983 Kato et al. ..... 318/603
4,730,152 * 3/1988 Foust et al. ..... 318/603
4,871,954 * 10/1989 Rathgeber ..... 318/466
5,038,087 * 8/1991 Archer et al. ..... 318/469
5,729,101 * 3/1998 Richmind et al. ..... 318/282
5,783,939 * 7/1998 Lippmann et al. ..... 327/154 R
5,965,994 * 10/1999 Seo ..... 318/280
6,043,880 * 3/2000 Andrews et al. ..... 356/311

* cited by examiner

*Primary Examiner*—Robert E. Nappi
*Assistant Examiner*—Ritor Leykin
(74) *Attorney, Agent, or Firm*—Quarles & Brady; George E. Haas

(57) ABSTRACT

An actuator is operated to move a mechanical device between two extreme positions of travel. While that motion is occurring, the system quantifies the amount of movement that occurs between those positions. The quantification may involve counting the number of steps of a stepper motor. The number of steps may be used directly as a quantification. Alternatively, the number of steps can be multiplied by the time period of each step to derive the time of the movement between the extreme positions. In addition to being used to setup the actuator upon installation, this automatic ranging method can be performed periodically to compensate for effects of wear on the mechanical device.

13 Claims, 2 Drawing Sheets

METHOD FOR AUTOMATICALLY DETERMINING RANGE OF MOVEMENT OF AN ELECTROMECHANICAL ACTUATOR

BACKGROUND OF THE INVENTION

The present invention relates to electrical actuators for operating a mechanical device, such as valves and dampers; and more particularly to techniques for automatically determining the range of travel for the device.

Many types of mechanical devices are operated by an electrical actuator which moves components of the device between two extreme positions. For example, the damper in a heating, ventilation and air conditioning (HVAC) system may employ an electric motor to move the damper plate between fully opened and fully closed positions. In other mechanical systems, an electric motor opens and closes a valve to control the flow of a liquid. It may also be desirable in some applications to place the damper or the valve at various positions between fully open and fully closed to provide a variable flow of air or liquid.

The mechanical linkage of different types of valves and HVAC dampers require different amounts of rotation to move them between the fully opened and fully closed positions. For example, the mechanical configuration of some HVAC dampers require only 45° of movement to move the damper between those extreme positions, while other dampers require 60° or 90° of movement. Universal actuators are available which rotate their output coupling a maximum of 95°, thus being able to accommodate several types of dampers. Employing a universal actuator eliminates having to stock a variety of actuators specifically designed for each type of mechanical device being driven. However, in order to properly operate a particular damper, the HVAC controller must be configured with the amount of travel or movement that the actuator has to provide to move the mechanical device between its extreme positions. That configuration also enables the controller accurately to place the damper at various desired intermediate positions.

Previously the controller was configured manually with the appropriate amount of rotational movement required by the associated damper. Such manual configuration was time consuming and prone to human error. In addition, the controller had to be reconfigured periodically to compensate for wear of the mechanical device.

SUMMARY OF THE INVENTION

A general object of the present invention is to provide a method by which a controller for an electromechanical actuator can automatically determine the range of movement for a particular mechanical device to which the actuator is connected.

Another object is to provide such an auto ranging mechanism that is periodically recalibrated to compensate for the effects of wear on the mechanical device.

These and other objectives are satisfied by a method which commences by placing the mechanical device into the one of the extreme positions of its range of movement. Then the actuator is energized to move the mechanical device into the other extreme position.

While the device is moving, the amount of movement which occurs for the mechanical device to reach the second extreme position from the first extreme position is quantified. That amount of movement can be quantified by any of several measurement parameters. For example, the time of movement may be measured, or when a stepper motor is used, the number of steps can indicate the range of movement. The time of movement may be derived indirectly by the number of steps multiplied by the period of each one to derive the time of the movement between the extreme positions.

DETAILED DESCRIPTION OF THE INVENTION

Figure 1:
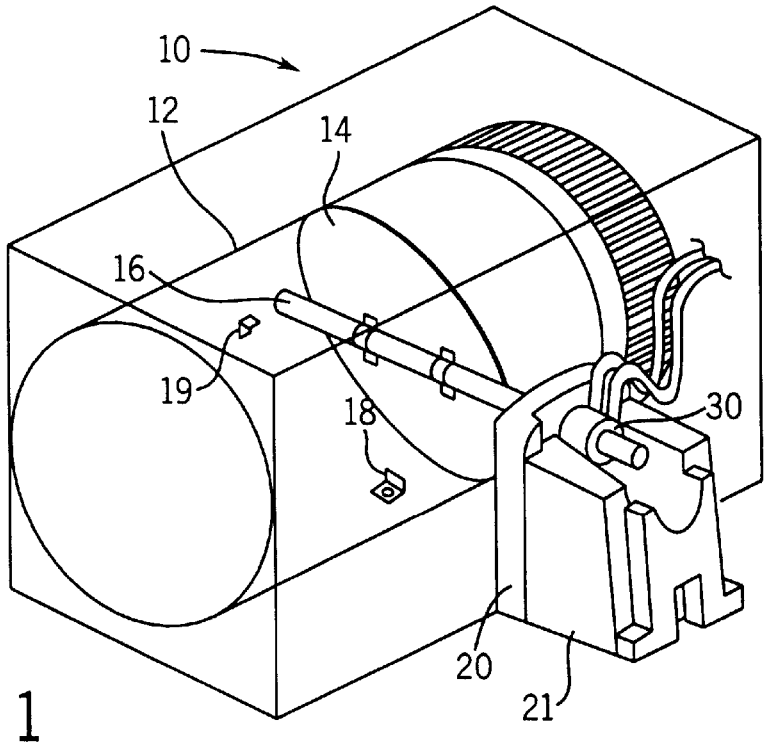
FIG. 1 is an isometric view of a damper with an actuator connected thereto.

With initial reference to FIG. 1, a mechanical device such as a VAV box 10 for a HVAC system has a circular duct 12 with a circular plate 14 which is mounted within the duct on shaft 16. By rotating the shaft 16, the plate 14 can be pivoted 90° between fully opened and fully closed positions. The damper plate 14 strikes a first stop 18 when in the fully closed position and strikes a second stop 19 in the fully opened position. The damper plate 14 also may assume an infinite number of orientations between the fully opened and fully closed positions.

The shaft 16 for damper plate 14 extends through an aperture of the side wall of the duct 12 where it is engaged by an actuator 20. Actuator 20 receives a command from a controller 21 for the HVAC system which directs the actuator to move the damper plate 14 into a given position. The given position may be fully opened, fully closed, or any one of a number of positions therebetween. The actuator 20 responds to the command signal by rotating the damper shaft until the desired position is achieved. The command signal indicates a percentage that the damper is to be opened and the controller 21 then determines from that percentage command how much to rotate the damper rod and plate.

Figure 2:
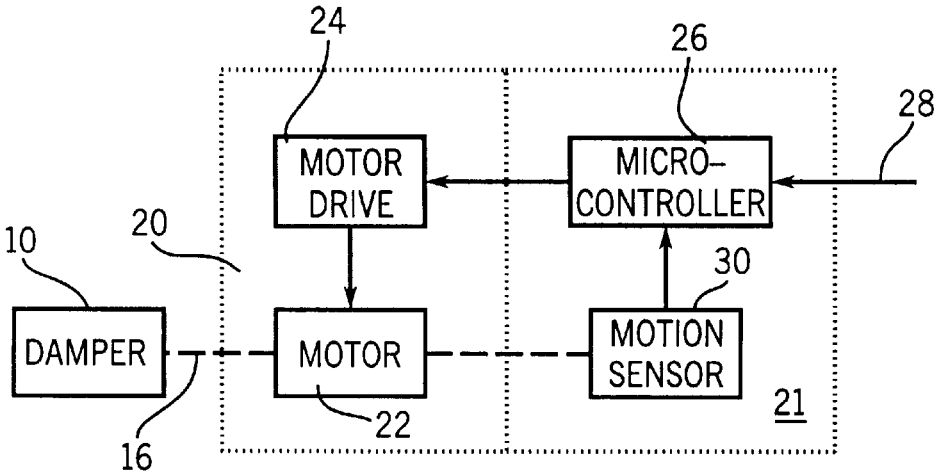
FIG. 2 is a block schematic diagram of the actuator and a controller.

With reference to FIG. 2, the actuator 20 comprises a stepper motor 22 which is connected to drive the damper shaft 16. In point of fact, the damper motor may be connected by a reduction gear assembly to the damper shaft 16 so that many revolutions of the motor are required to rotate that shaft 90° between the fully opened and fully closed positions of the damper. For example, in a typical embodiment of the present invention 23,000 steps of the stepper motor 22 may be required to rotate the motor 95° which is the maximum amount of its travel. Thus the 95° motion produced by the actuator 20 can accommodate mechanical devices such as VAV box damper plate 14 which have extreme limits of travel between 0° and 90°. The motor 22 is stepped by electrically pulses received from a conventional motor drive circuit 24 which is operated by a microcontroller 26. The microcontroller responds to commands received on communication network 28 from the HVAC controller for the building zone in which the VAV box 10 is located or from feedback received from a velocity pressure sensor as in variable air volume applications.

With continuing reference to FIGS. 1 and 2, the damper shaft 16 extends through the actuator 20 where a motion sensor 30 is mounted to produce a signal indicative of shaft movement. This motion sensor 30 may be mounted on the damper shaft 16 or on any of the gear passes within the actuator 20. For example, the motion sensor 30 may be a Hall effect type or an optical type device which emits electrical pulses periodically while the shaft 16 is moving. The pulsed output signal from the motion sensor 30 is applied as an input to the microcontroller 26 so that the microcontroller is able to detect whether the shaft is in motion. Alternatively, certain motors produce an increase in current when the shaft stops rotating. Such current increase can be detected by the controller. As will be described, when the damper plate 14 abuts one of the stops 18 or 19 in an extreme position of rotation, the motor 22 stalls which is indicated by the cessation of electrical pulses from the motion sensor 30 or a current increase from the motor.

Although the present VAV box damper plate 14 is rotated 90° between the fully opened and fully closed positions, other dampers may have different degrees of movement between those extreme positions. It is not uncommon for dampers to rotate 45° or 60° between those extreme positions. As a consequence, the microcontroller 26 must know the range of rotation between the extreme positions of the particular damper on which it is mounted. Otherwise electrical pulses may continue to be applied to the stepper motor after the damper abuts a stop, which could adversely affect the motor 22 or bend the damper stops 18 and 19.

Therefore, whenever the actuator 20 is powered up, the microcontroller 26 executes a routine stored within its internal memory that determines the range of movement between the fully opened and fully closed positions of the damper. Thus the microcontroller automatically learns the full range of movement for the particular mechanical device to which the actuator is attached. That information is useful in determining how to operate the motor in order to move the damper to fully open and fully closed positions, as well as various commanded positions therebetween. In addition to being executed whenever power is initially applied to the actuator 20, the automatic ranging routine may also be executed periodically (e.g. once a month) to account for slippage of the damper plate 14 on the shaft 16 and for worn damper seals. Whenever it is executed, the automatic ranging routine may provide the results as diagnostic signals to a facility management system for the building, for example.

Figure 3:
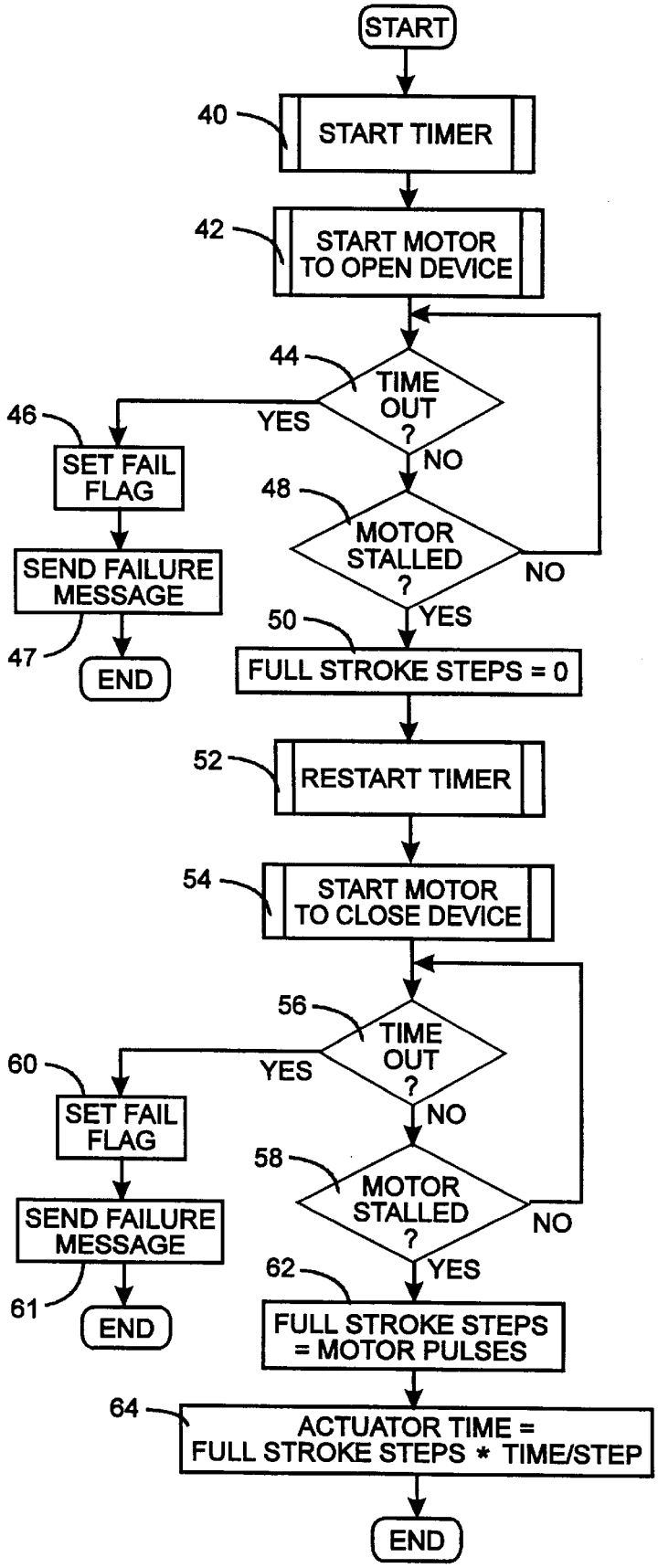
FIG. 3 is a flow chart of an auto ranging routine which is executed by the controller within the actuator.

Upon commencement of the automatic ranging routine depicted in FIG. 3, the microcontroller 26 starts a software timer at step 40 with a known value. If the routine has not been executed before, that value corresponds to the time period required for the actuator to move its 95° maximum travel. This 95° value is slightly greater than the 90° travel necessary to move the damper plate 14 between its extreme travel positions to account for poorly positioned end stops 18 and 19. Once started the timer begins decrementing the known value.

Then the program execution advances to step 42 at which the microcontroller issues a sequence of signals to the motor drive 24 which causes the motor 22 to step toward the open position of the VAV box damper plate 14. At step 44 the microcontroller 26 inspects its internal timer to determine whether the timer period has elapsed. If it has, this would be an indication that the shaft is slipping. If so, the microcontroller sets a failure flag at step 46 and a failure message is sent over the communication network 28 to a central monitoring station at step 47 before the automatic ranging routine terminates. However, on most occasions the timer will not have timed-out at step 44 and the program execution will advance to step 48. At that juncture, the microcontroller 26 checks the signals from the motion sensor 30 to determine whether the motor 22 still is operating. The program execution continuously loops through steps 44 and 48 until either the time-out or a motor stall occurs.

Eventually the microcontroller 26 will no longer detect pulses being emitted by the motion sensor 30, indicative that the motor has stalled due to the damper plate 14 striking the second stop 19 in the fully open position. The automatic ranging routine then advances to step 50 where a variable designated FULL STROKE STEPS is set to zero. Then the software timer is reset at step 52 by the microcontroller 26 to the same value as before.

Next the microcontroller sends signals to the motor drive 24 which cause the motor 22 to step in the opposite direction moving the damper plate 14 to the fully closed position. While this is occurring, the program execution loops through steps 56 and 58 where the microcontroller 26 checks for a timer time-out or a motor stall, respectively. If at step 56 the time-out is detected the failure flag is set at step 60 and a failure message is sent over the communication network 28 to a central monitoring station at step 61 before the automatic ranging routine terminates. Termination of the automatic ranging routine with the failure flag set indicates that the procedure failed to execute properly and has not provided the proper output variables, as will be described.

When a motor stall is detected at step 58, the damper plate 14 is likely to have reached the fully closed position at which it abuts the first stop 18. Upon this detection the program execution branches to step 62 where the FULL STROKE STEPS variable is set equal to the number of electrical pulses which drove the motor 22 between the fully opened and fully closed positions. This number of motor pulses indicates the rotational distance that the damper plate 14 moved between those extreme positions. At step 64, the time which was required for that motion of the damper plate is computed by multiplying the number of FULL STROKE STEPS by the time per motor step. The resultant value designated ACTUATOR TIME is stored within the memory of the microcontroller 26 and the automatic ranging routine terminates.

At the culmination of the automatic ranging routine, the memory of the microcontroller 26 stores the amount of motion of the damper between its extreme positions in terms of the number of stepper motor steps and the time of motion. Either of those values then can be utilized to properly control the stepper motor 22. For example, when the microcontroller 26 receives a command to move the damper plate from one extreme position to the other, either the number of stroke steps required or the actuator time can be employed to ensure that full motion of the damper plate occurs without continuing to drive the motor 22 after the damper plate has struck one of the stops 18 or 19. In addition, when the microcontroller 26 receives a command on communication network 28 to move the damper plate to an intermediate position, for example thirty percent from fully closed to fully opened the microcomputer can determine that position in terms of either movement time or motor steps. This is accomplished by multiplying the desired position, e.g. thirty percent, by the number of FULL STROKE STEPS or the ACTUATOR TIME.

The present invention provides a mechanism by which an actuator 20 automatically determines the amount of movement of the driven mechanical mechanism, such as the VAV box damper plate 14, between the extreme positions of that device's motion. As a consequence, when the system is first installed, the technician need not manually designate that amount of movement. In addition when drift or other changes in the operation of the mechanical device occur over time, periodic execution of the automatic ranging routine ensures that the actuator will properly operate the device.

This method also can be applied to fluid valves, such as water or steam valves in HVAC applications. Precise control of flow can be achieved along with detection of worn valve seats or stuck valves.

We claim:

1. A method for determining a range of motion of a mechanical device which when operated by an actuator moves between first and second extreme positions of travel, said method comprising:

placing the mechanical device into the first extreme position;

from the first extreme position, energizing the actuator to move the mechanical device into the second extreme position;

starting a timer upon energizing the actuator to move the mechanical device into the second extreme position;

terminating the method if the mechanical device fails to reach the second extreme position within a predefined period of time;

quantifying an amount of movement which occurs for the mechanical device to reach the second extreme position from the first extreme position by measuring an amount of time which elapses during movement of the mechanical device between the first and second extreme positions and producing a value representing the amount of time; and storing the value in a memory device.

2. The method as recited in claim 1 wherein placing the mechanical device into the first extreme position comprises energizing the actuator to move the mechanical device.

3. The method as recited in claim 1 further comprising sensing movement of the mechanical device; and determining that the mechanical device has reached the second extreme position when the mechanical device stops moving.

4. The method as recited in claim 1 further comprising sensing when the actuator stalls; and determining that the mechanical device has reached the second extreme position in response to the actuator stalling.

5. The method as recited in claim 1 wherein the motor is a stepper motor, and quantifying an amount of movement comprises counting how many steps of the motor occur between the first and second extreme positions to produce a step count.

6. The method as recited in claim 5 wherein quantifying an amount of movement further comprises calculating an amount of time which elapses by multiplying the step count by a time period for each step.

7. The method as recited in claim 1 further comprising sending a failure message to a monitoring station if the mechanical device fails to reach the second extreme position within a predefined period of time.

8. A method for determining a range of motion of a mechanical device which when operated by a stepper motor can be moved between first and second extreme positions of travel, said method comprising:

energizing the stepper motor to move the mechanical device into the first extreme position;

starting a timer upon energizing the stepper motor to move the mechanical device into the first extreme position;

detecting when the mechanical device reaches the first extreme position;

terminating energizing the stepper motor upon the mechanical device failing to reach the first extreme position within a predefined period of time;

thereafter energizing the stepper motor to move the mechanical device into the second extreme position;

detecting when the mechanical device reaches the second extreme position;

counting how many steps of the stepper motor occur between the first and second extreme positions to produce a step count; and calculating an amount of time which elapses by multiplying the step count by a time period for each step.

9. The method as recited in claim 8 wherein detecting when the mechanical device reaches the first extreme position comprises sensing when the stepper motor stops moving the mechanical device.

10. The method as recited in claim 8 further comprising sending a failure message to a monitoring station upon the mechanical device fails to reach the first extreme position within a predefined period of time.

11. The method as recited in claim 8 wherein detecting when the mechanical device reaches the second extreme position comprises sensing when the stepper motor stops moving the mechanical device.

12. A method for determining a range of motion of a mechanical device which when operated by a stepper motor can be moved between first and second extreme positions of travel, said method comprising:

energizing the stepper motor to move the mechanical device into the first extreme position;

detecting when the mechanical device reaches the first extreme position;

thereafter energizing the stepper motor to move the mechanical device into the second extreme position;

starting a timer upon energizing the stepper motor to move the mechanical device into the second extreme position;

detecting when the mechanical device reaches the second extreme position;

terminating energizing the stepper motor if the mechanical device fails to reach the second extreme position within a predefined period of time;

counting how many steps of the stepper motor occur between the first and second extreme positions to produce a step count; and calculating an amount of time which elapses by multiplying the step count by a time period for each step.

13. The method as recited in claim 12 further comprising sending a failure message to a monitoring station if the mechanical device fails to reach the first extreme position within a predefined period of time.

* * * * *